US007719491B2

(12) United States Patent
Lin et al.

(10) Patent No.: US 7,719,491 B2
(45) Date of Patent: May 18, 2010

(54) METHOD FOR DRIVING A PLASMA DISPLAY PANEL

(75) Inventors: Chi-Hsiu Lin, Yunlin County (TW); Ming-Zhang Lin, Tainan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1103 days.

(21) Appl. No.: 11/307,545

(22) Filed: Feb. 13, 2006

(65) Prior Publication Data

US 2007/0188414 A1 Aug. 16, 2007

(51) Int. Cl.
*G09G 3/28* (2006.01)

(52) U.S. Cl. ..... 345/72

(58) Field of Classification Search ..... 345/160–172; 315/169.4

See application file for complete search history.

(56) References Cited

U.S. PATENT DOCUMENTS 7,173,579 B2 * 2/2007 Lee ..... 345/60
7,542,015 B2 * 6/2009 Son ..... 345/67

FOREIGN PATENT DOCUMENTS

KR 2002-0088768 * 11/2002
KR 10-0390886 7/2003

* cited by examiner

*Primary Examiner*—Bipin Shalwala
*Assistant Examiner*—Steven E Holton
(74) *Attorney, Agent, or Firm*—Jianq Chyun IP Office

(57) ABSTRACT

A driving circuit of a plasma display panel (PDP) and a reset circuit thereof are disclosed. The above-mentioned driving circuit includes a reset circuit and a sustaining circuit. The reset circuit is connected to a display cell of the PDP and generates a reset signal for the above-mentioned display cell by means of an LC resonance. The sustaining circuit provides a sustaining voltage to the above-described display cell during the sustaining period of the display cell.

2 Claims, 3 Drawing Sheets

New Sheet

METHOD FOR DRIVING A PLASMA DISPLAY PANEL

BACKGROUND OF THE INVENTION

1. Field of Invention

The present invention relates to a driving circuit of a plasma display panel (PDP), and particularly to a reset circuit of a PDP.

2. Description of the Related Art

When driving a Plasma Display Panel (PDP), a cycle of a sequential reset period, addressing period and sustaining period is repeated for driving operations. Wherein, the operation during the reset period is used for clearing and resetting wall charges of PDP display cells; the operation during the addressing period is used for addressing the display cells; the operation during the sustaining period is used for sustaining luminance of the addressed display cells.

FIG. 1 is a schematic drawing of a conventional PDP driving circuit. For simplicity, only one display cell 103 and the driving circuit thereof are shown in FIG. 1, and the circuit for the operation during the addressing period is omitted. The display cell 103 has three electrodes, i.e. a scan electrode, a bulk electrode and an addressing electrode. In FIG. 1, a sustaining circuit 101 and a reset circuit 102 are electrically connected to the scan end of the display cell 103, while the sustaining circuit 104 is electrically connected to the bulk end of the display cell 103. The sustaining circuits 101 and 104 are symmetrical.

The sustaining circuits 101 and 104 serve for providing the display cell 103 with AC sustaining voltage during the sustaining period. The reset circuit 102 serves for producing a reset signal to the display cell 103 during the reset period, wherein the reset signal is used for clearing and resetting wall charges. Cp represents an equivalent capacitance of the PDP in the display cell 103. As a switch Q1 is on, the current from a voltage source Vd would pass through a diode D1 and the switch Q1, which results in a RC resonance of a resistor R and the capacitance Cp, further producing a reset signal for clearing and resetting wall charges. In this embodiment, the reset signal is an exponential waveform. The detail for controlling switches Q1~Q7 during driving the display cell 103 should be known to those skilled in the art and are not repeated herein.

The disadvantage of the above-described conventional scheme is when the wall charges are to be effectively cleared and reset, a feeble discharge is essentially needed, making the voltage applied to the capacitor Cp slowly fall. The slowly falling of the voltage requires a longer reset time, but the longer the reset period, the longer the backlight is up. Thus, the sustaining period affecting the average luminance of a display cell would be accordingly shorter and the display quality degrades. On the other hand, the equipped resistor R requires a more complex process and a higher cost.

Although the sustaining circuit 101 may provide an LC resonance between an inductor Ls and a capacitor Cp, the resonance frequency and reset waveform required by each is different. The resonance of the sustaining circuit 101 actually plays a much different role from the resonance to build up the reset signal, limiting and confining the application of the resonance of the sustaining circuit 101.

SUMMARY OF THE INVENTION

An object of the present invention is to provide a PDP reset circuit, suitable for significantly shortening the reset period and improving the display quality.

Another object of the present invention is to provide a PDP driving circuit, suitable for significantly shortening the reset period, reducing the circuit cost and easily adjusting the reset signal frequency.

To reach the above-described objects, the present invention provides a PDP reset circuit, which includes a first switch and an inductor. The first switch is electrically connected to a first voltage source, while the inductor is electrically connected between the first switch and a display cell of the PDP.

In the above-described reset circuit of an embodiment, a diode and a capacitor are further included. The diode is electrically connected between the first voltage source and the first switch, while the capacitor is electrically connected between the diode and a sustaining circuit.

In the above-described reset circuit of an embodiment, the sustaining circuit includes a fourth switch and a fifth switch, wherein the fourth switch is electrically connected between a second voltage source and the capacitor, while the fifth switch is electrically connected between the capacitor and the ground.

In the above-described reset circuit of an embodiment, to produce the reset signal, the operation requires three periods. During the first period, the first switch and the fourth switch are off, while the fifth switch is on. During the second period, the fifth switch is off, and then the fourth switch is on. During the third period, the first switch is on.

On the other hand, the present invention further provides a PDP driving circuit, which includes a reset circuit and a sustaining circuit. The reset circuit is electrically connected to a display cell of a PDP and produces a reset signal of the above-described display cell by means of an LC resonance (inductance-capacitance resonance). The sustaining circuit provides the above-described display cell with a sustaining voltage during the sustaining period.

According to an embodiment of the present invention, instead of a RC resonance (resistance-capacitance resonance) used in the prior art, the present invention uses an LC resonance, therefore the reset period can be significantly shortened. A shorter reset period would contribute to reducing the backlight and increasing dark room contrast ratio (DRCR). The saved time can be used for delivering more scan signals to support higher resolution or for delivering more sustaining signals to improve the chroma displayed. In short, due to a shorter reset period, the display quality is consequently advanced.

According to an embodiment of the present invention, another advantage in the present invention is no extra circuit required. In fact, only one component in the original circuit needs to be changed; that is, the resistor in the original reset circuit needs to be replaced by an inductor. Since the modified inductor process is simpler compared with the original resistor, a lower circuit cost is expected.

Moreover, the inductor in the reset circuit, not the original inductor in the sustaining circuit, is used in the present invention. Therefore, the circuit has higher modifiability, so that it is easier to adjust the reset signal frequency regardless of the operation frequency required by the original sustaining circuit and the function thereof.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve for explaining the principles of the invention.

DESCRIPTION OF THE EMBODIMENTS

Figure 1:
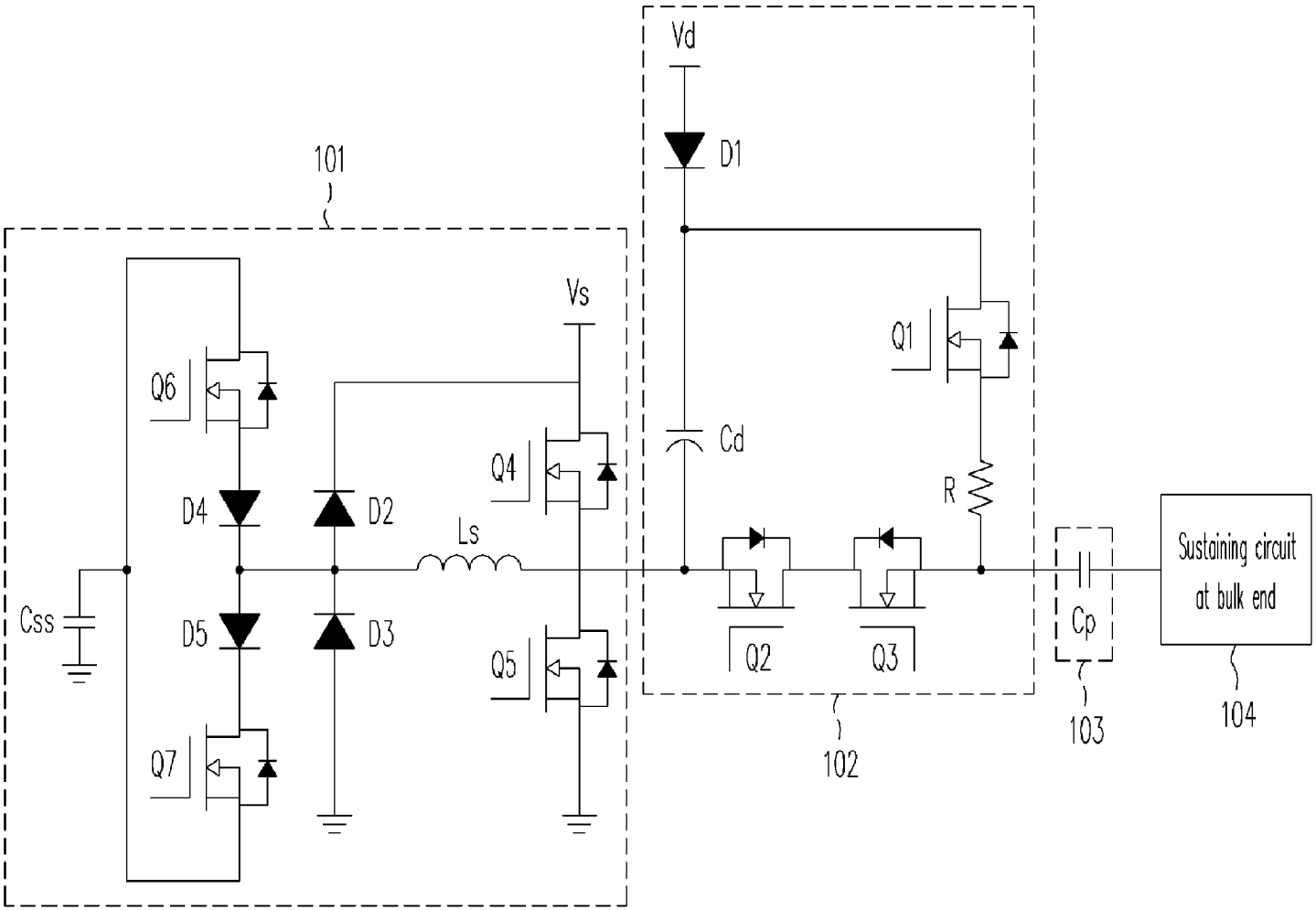
FIG. 1 (PRIOR ART)
FIG. 1 is schematic drawing of a conventional PDP driving circuit.
Figure 2:
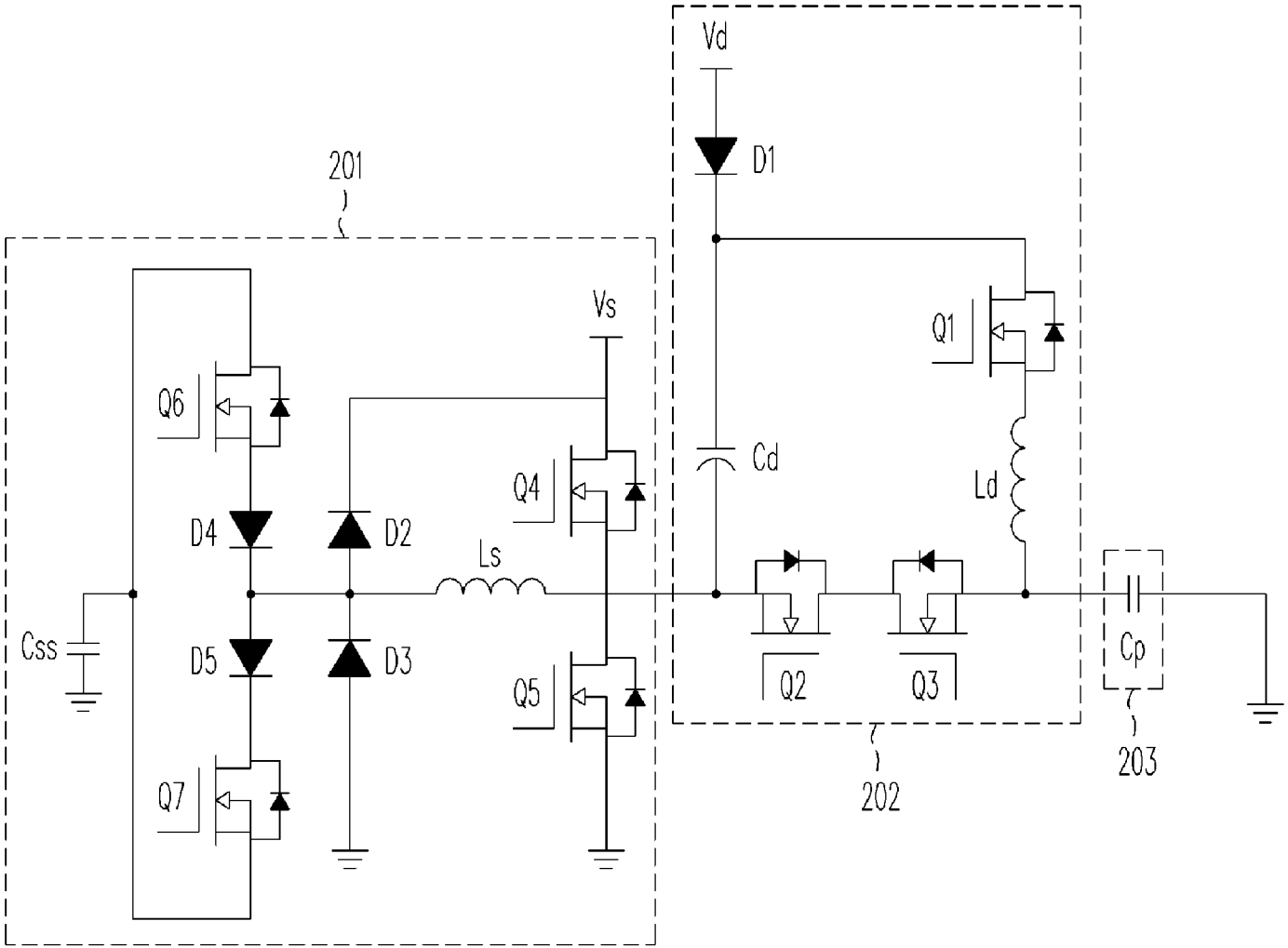
FIG. 2 is schematic drawing of a PDP driving circuit according to an embodiment of the present invention.

FIG. 2 is schematic drawing of a PDP driving circuit according to an embodiment of the present invention. The driving circuit in FIG. 1 includes a reset circuit 202 and a sustaining circuit 201. The reset circuit 202 is electrically connected to a display cell 203 of a PDP and produces a reset signal for the display cell 203 by means of an LC resonance. The sustaining circuit 201 provides the display cell 203 with a sustaining voltage during the sustaining period.

The major difference of the reset circuit 202 in FIG. 2 from the reset circuit 102 in FIG. 1 is that the resistor R in FIG. 1 is replaced by an inductor Ld in FIG. 2, so that the conventional scheme using a RC resonance is modified by using an LC resonance in the present invention. The other configurations in the sustaining circuit 201 of FIG. 2 or in the sustaining circuit 101 of FIG. 1, are the same. In the embodiment, the reset circuit 202 is electrically connected to the scan end of the display cell 203, and the driving circuit at the bulk end of the display cell 203 and the sustaining circuit 201 are symmetrical. However, in the present embodiment, the reset circuit 202 plays the major role and the bulk end of the display cell 203 during the reset period keeps grounded, therefore, the bulk end of the display cell 203 in FIG. 2 is illustrated as grounded.

The reset circuit 202 includes a diode D1, switches Q1~Q3, an inductor Ld and a capacitor Cd. Wherein, the anode of the diode D1 is electrically connected to a voltage source Vd. The switch Q1 is electrically connected between the cathode of the diode D1 and the upper end of the inductor Ld. The upper end of the inductor Ld is electrically connected to the switch Q1, while the lower end thereof is electrically connected to the switch Q3 and the scan end of the display cell 203. The upper end of the capacitor Cd is electrically connected to the cathode of the diode D1 and the switch Q1, while the lower end thereof is electrically connected to the switch Q2 and both switches Q4 and Q5 of the sustaining circuit 201. The left end of the switch Q2 is electrically connected to the lower end of the capacitor Cd and both switches Q4 and Q5 of the sustaining circuit 201, while the right end thereof is electrically connected to the switch Q3. The right end of the switch Q3 is electrically connected to the lower end of the inductor Ld and the scan end of the display cell 203.

The components in the sustaining circuit closely related to the embodiment are the switches Q4 and Q5. The upper end of the switch G4 is electrically connected to a voltage source Vs, the lower end thereof is electrically connected to the lower end of the capacitor Cd and the upper end of the switch G5. The upper end of the switch G5 is further electrically connected to the lower end of the capacitor Cd, while the lower end thereof is grounded.

Figure 3:
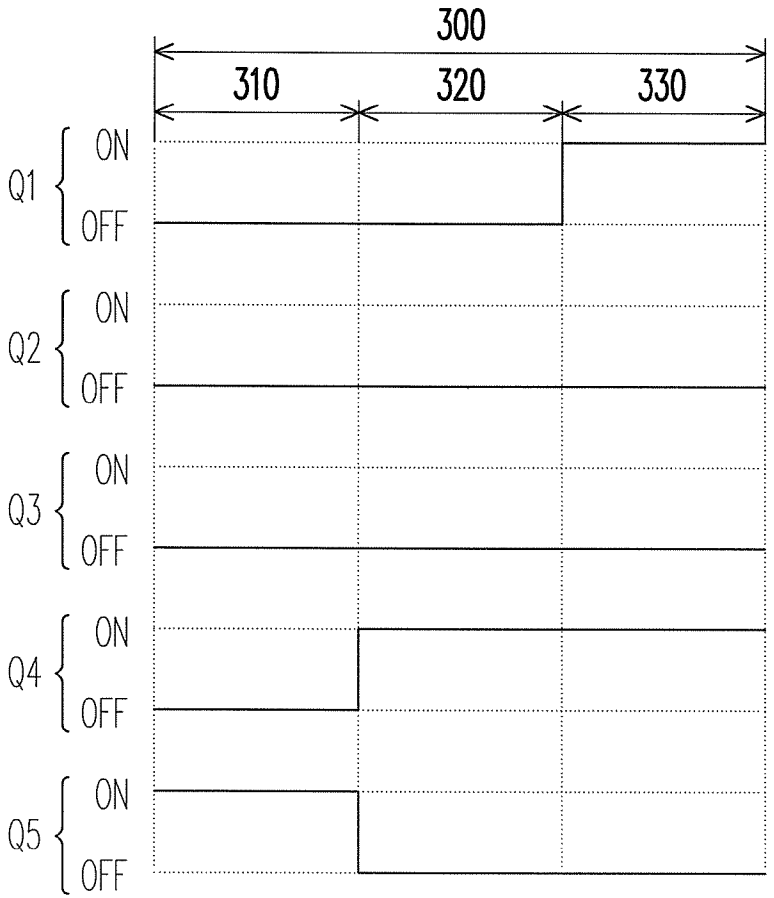
FIG. 3 is a timing diagram showing the operation of the switches of the PDP driving circuit in FIG. 2.

By means of an LC resonance induced by the inductor Ld and the capacitor Cp, the reset circuit 202 generates a reset signal for the display cell 203. The capacitor Cp is the equivalent capacitance of the PDP in the display cell 203. Please refer to FIG. 3, which is a timing diagram showing the operation of the switches Q1-Q5 of the PDP driving circuit in FIG. 2. During the reset period 300, the switches Q2 and Q3 are off all the time. The process for the reset circuit to generate a reset signal includes three phases. These three phases are shown as 310-330 in FIG. 3.

In the first phase 310, the switches Q1 and Q4 are off while the switch Q5 is on. At the point, the upper end of the capacitor Cd is electrically connected to the voltage source Vd, while the lower end thereof is grounded. Meanwhile, the capacitor Cd starts to be charged until the voltage at both ends of the capacitor raise to the voltage of the voltage source Vd, In the second phase 320, the switch Q5 is off, and then the switch Q4 is on, which makes the lower end of the capacitor Cd coupled to the voltage source Vs. The voltage of the capacitor can not be transiently changed, therefore the voltage level at the upper end of the capacitor Cd would immediately surge to the voltage of(Vd+Vs). In the embodiment, the voltage of Vd is 60V and the voltage of Vs is 180V, thus the voltage at the upper end of the capacitor Cd is transiently 240V. In the third phase 330 finally, the switch Q1 is on. The storage energy in the capacitor Cd herein is capable of inducing a resonance between the inductor Ld and the capacitor Cp. As the capacitor Cd is discharged, the current passing the inductor Ld can not quickly follow the change in time, therefore the discharge energy is restricted and only a feeble discharge is generated. In this way, the reset signal can be generated for the purpose of clearing and resetting the wall charges of the display cell 203.

Except for the above-described process, a 240V high voltage can be provided at the voltage source Vd in the embodiment. With such high voltage, the reset signal can be directly generated without the above pulling-up voltage process.

Except for replacing the original resistor in a reset circuit with an inductor, the embodiment further needs to modify the original driving code for rearranging the control signals of the switches Q1~Q7. The driving code modification should be well known for those skilled in the art after reviewing the presented circuit layout in FIGS. 1 and 2.

The following table 1 lists some experiment comparison results between the conventional circuit and the one provided by the embodiment. It can be seen from the table, that for a totally black screen display, the average luminance of the embodiment is about a half of that using the conventional circuit, the power consumption of the embodiment is less than that of the conventional circuit and the reset time of the embodiment is dramatically shorter than that of the conventional circuit. Besides, supposing the peal luminance of a regular PDP is 1500 cd/m$^2$, then the dark room contrast ratio (DRCR) for the conventional circuit is 1500/0.25=6000, while the dark room contrast ratio (DRCR) for the circuit of the embodiment is 1500/0.13=11538, thus a significantly larger DRCR is obtained.

TABLE 1

Experiment Comparison Result Between Conventional Circuit And The Present Embodiment

| | Average luminance of total black screen | power consumption in total black screen | Reset time |
|---|---|---|---|
| Conventional circuit | 0.25 cd/m$^2$ | 75.8 W | 165 μs |
| Present embodiment | 0.13 cd/m$^2$ | 74.9 W | 10 μs |

Although the reset circuit 202 of the embodiment is electrically connected to the scan end of the display cell 203 in the embodiment, it is not limited thereof. In the other embodiments of the present invention, the reset circuit can be alternatively electrically connected to the bulk end of the display cell. The corresponding driving circuit layout at the scan end and rearranging the control signals of the switches should be known to those skilled in the art, hence are omitted herein for simplicity.

It can be seen from the above described that the LC resonance of the embodiment, instead of the RC resonance in the prior art, makes the reset period significantly shorter. Along with a shorter reset period, the backlight is reduced and the dark room contrast ratio (DRCR) is increased. The saved time can be used for delivering more scan signals to support higher resolution or for delivering more sustaining signals to improve the chroma displayed. In short, along with a shorter reset period, the display quality can be enhanced.

Another advantage of the present invention is that to implement the present invention, no extra circuit is required. In the original circuit, only one component needs to be changed; that is, the resistor of the original reset circuit is replaced by an inductor. Since the inductor process is relatively simpler, the circuit cost is expected to be reduced as well.

A further advantage of the present invention is that a newly equipped inductor in the reset circuit is employed without using the original inductor in the sustaining circuit, which provides higher modifiability for adjusting the reset signal frequency without the restriction of operation frequency and the function of the original sustaining circuit. Moreover, the resonance energy can be directly supplied by the voltage source, which is much better than using capacitor storage energy in the sustaining circuit.

It will be apparent to those skilled in the art that various modifications and variations can be made to the structure of the present invention without departing from the scope or spirit of the invention. In view of the foregoing, it is intended that the specification and examples to be considered as exemplary only, with a true scope and spirit of the invention being indicated by the following claims and their equivalents.

What is claimed is:

1. A method for driving a plasma display panel (PDP), the PDP comprising a display cell, a reset circuit and a sustaining circuit, the reset circuit comprising an inductor, a diode, a capacitor, a first switch, a second switch and a third switch, the diode electrically connected to a first voltage source, the first switch electrically connected to the diode, the inductor electrically connected between the first switch and the display cell, the capacitor electrically connected between the diode and the sustaining circuit, the second switch electrically connected to the capacitor, the third switch electrically connected between the second switch and the display cell, the sustaining circuit comprising a fourth switch and a fifth switch, the fourth switch electrically connected between a second voltage source and the capacitor, the fifth switch having an end electrically connected to the capacitor and another end grounded, the method comprising:

turning off the first switch and the fourth switch and turning on the fifth switch during a first phase;

turning on the fourth switch and turning off the fifth switch during a second phase after the first phase;

turning on the first switch during a third phase after the second phase; and turning off the second switch and the third switch in the first phase, the second phase and the third phase.

2. A method for driving a plasma display panel (PDP), the PDP comprising a display cell, a reset circuit and a sustaining circuit, the reset circuit electrically connected to the display cell and generating a reset signal for the display cell through an LC resonance, the sustaining circuit electrically connected to the reset circuit and providing the display cell with a sustaining voltage during a sustaining period of the display cell, the reset circuit comprising an inductor, a diode, a capacitor, a first switch, a second switch and a third switch, the diode electrically connected to a first voltage source, the first switch electrically connected to the diode, the inductor electrically connected between the first switch and the display cell, the capacitor electrically connected between the diode and the sustaining circuit, the second switch electrically connected to the capacitor, the third switch electrically connected between the second switch and the display cell, the sustaining circuit comprising a fourth switch and a fifth switch, the fourth switch electrically connected between a second voltage source and the capacitor, the fifth switch having an end electrically connected to the capacitor and another end grounded, the method comprising:

turning off the first switch and the fourth switch and turning on the fifth switch during a first phase;

turning on the fourth switch and turning off the fifth switch during a second phase after the first phase;

turning on the first switch during a third phase after the second phase; and turning off the second switch and the third switch in the first phase, the second phase and the third phase.

* * * * *